US005218183A

United States Patent [19]

Kimata

[11] Patent Number: 5,218,183

[45] Date of Patent: Jun. 8, 1993

[54] SELF TEMPERATURE CONTROL TYPE GLOW PLUG

[76] Inventor: Hiroyuki Kimata, No. 14-18 Takatsuji-cho, Mizuho-ku Nagoya 467, Japan

[21] Appl. No.: 770,161

[22] Filed: Oct. 2, 1991

[30] Foreign Application Priority Data

Oct. 4, 1990 [JP] Japan ..... 2-265143

[51] Int. Cl.[5] ..... H05B 3/02; F23Q 7/22; F02P 9/08

[52] U.S. Cl. ..... 219/270; 123/145 A; 219/552; 219/553

[58] Field of Search ..... 219/260–270, 219/544, 552, 553; 123/145 A, 145 R

[56] References Cited

U.S. PATENT DOCUMENTS 4,423,309 12/1983 Murphy ..... 219/270

4,476,378 10/1984 Takizawa et al. ..... 219/220

4,636,614 1/1987 Itoh et al. ..... 219/220

4,725,711 2/1988 Minegishi et al. ..... 219/270

*Primary Examiner*—Anthony Bartis

*Attorney, Agent, or Firm*—Cooper & Dunham

[57] ABSTRACT

A self temperature control type glow plug has a metallic shell in which ceramic heater having a glow resistor of a tungsten-based alloy embedded in a silicon nitride ceramic is placed in a manner to extend beyond the front end of the shell. A temperature-regulating resistor of nickel, iron or nickel-iron alloy is embedded within the metallic shell in series with the glow resistor. Each resistor has a positive temperature coefficient (PTC), with the positive temperature coefficient of the glow resistor being smaller than that of the temperature-regulating resistor. The electrical resistance ratio of the temperature regulating resistor to the glow resistor falls within a range of 0.35 to 0.60 at room temperature.

4 Claims, 3 Drawing Sheets

SELF TEMPERATURE CONTROL TYPE GLOW PLUG

BACKGROUND OF THE INVENTION

1. Field of the Invention

This invention relates to a self temperature control type glow plug which is used in a diesel engine to cope with cold starting.

2. Description of Prior Art

In a glow plug for use in a diesel engine, the energized glow plug burns a part of vaporized fuel injected into an auxiliary combustion chamber of the diesel engine cylinder to cope with cold starting.

Since this type of the glow plug needs a rapid temperature-rise characteristic, and having a recent tendency to be kept energized longer after starting the engine, it has been suggested to employ a ceramic heater which has a glow resistor embedded therein. It, however, has a possibility that the resistor may be melt down due to a rapid heating while the ceramic resistor may be broken due to thermal shock when the glow resistor is rapidly energized since the glow resistor is generally provided with high electrical resistance value.

In order to prevent the breakage and melt-down, a temperature-regulating resistor is connected in series with the glow resistor so as to provide a self-regulating type glow plug as shown in Japanese Patent Publication No. 55369/89 in which the temperature-regulating resistor works to adjust an amount of electrical current flowing through the glow resistor.

The self-regulating glow plug shown in Japanese Patent Publication No. 55369/89, however, has disadvantages that the self-regulation function may be significantly reduced to shorten an operating period of its service life depending upon an electrical resistance ratio of the temperature-regulating resistor to the glow resistor.

Therefore, it is an object of the invention to obviate the above disadvantages, and providing a self-regulating type glow plug which is capable of enhancing its self-regulating function to ensure an extended period of service life with a relatively simple construction.

SUMMARY OF THE INVENTION

According to the invention, there is provided a self temperature control type glow plug having a metallic shell in which a ceramic heater is placed in a manner to extend beyond a front end of the metallic shell. The ceramic heater has a glow resistor embedded therein. A temperature-regulating resistor is placed within the metallic shell in series with the glow resistor. Each of the resistors has a positive temperature coefficient. The positive temperature coefficient of the glow resistor is smaller than that of the temperature-regulating resistor. An electrical resistance ratio of the temperature-regulating resistor to the glow resistor falls within a range from 0.35 to 0.60 at room temperature.

The electrical resistance ratio of more than 0.35 maintains its good self-regulating function, and preventing the temperature of the ceramic heater from abnormally rising so as to protect the ceramic heater against the breakage even when the glow plug is kept energized longer after starting the engine.

The electrical resistance ratio of less than 0.60 prevents the self-regulating function from being excessively affected so as to prevent an overheat of the temperature-regulating resistor, thus facilitating the temperature rise of the ceramic heater to ensure the cold starting of the diesel engine.

These and other objects and advantages of the invention will be apparent upon reference to the following specification, attendant claims and drawings.

DETAILED DESCRIPTION OF THE EMBODIMENTS

Figure 1:
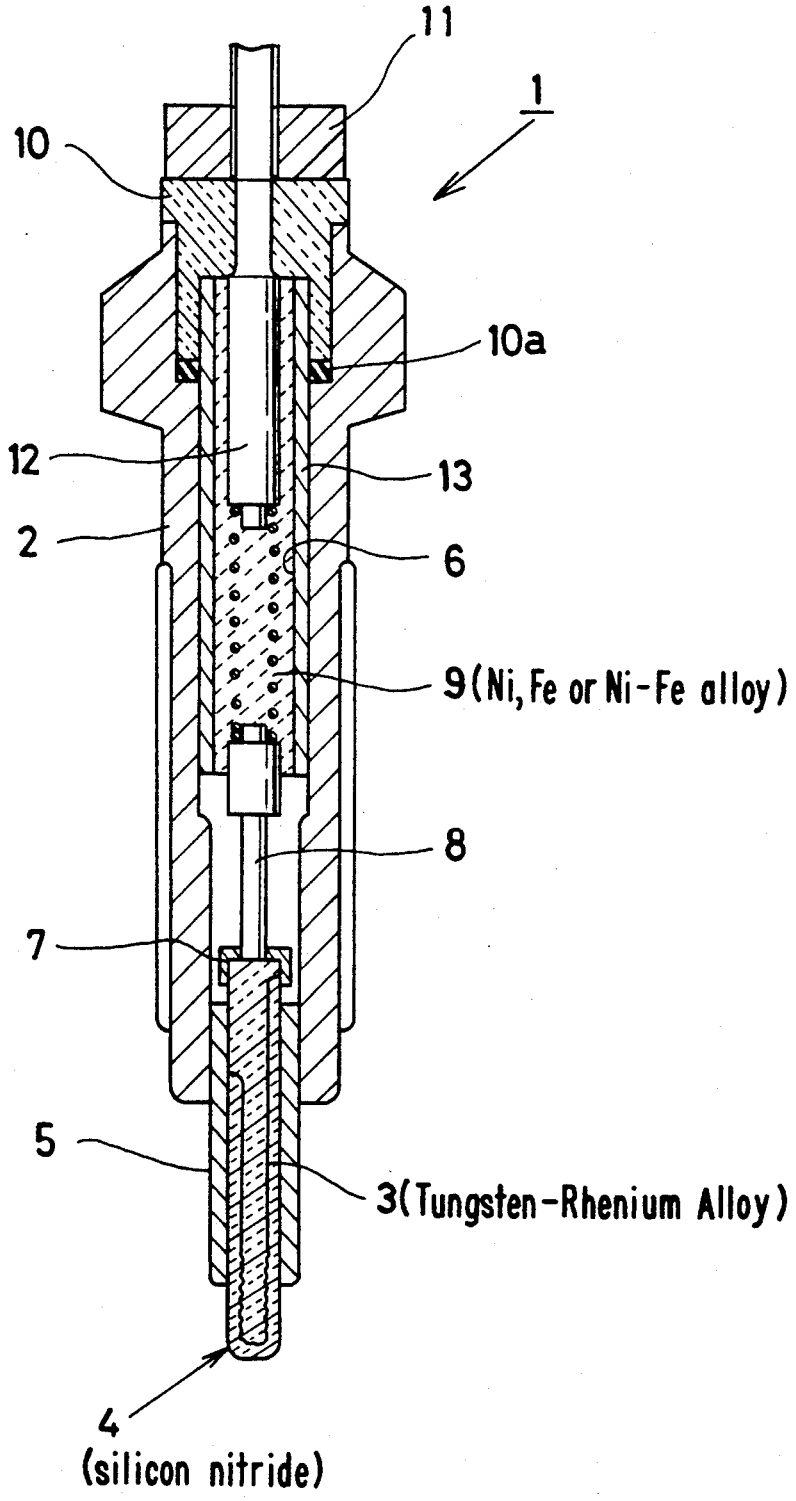
FIG. 1 is a longitudinal cross sectional view of a self-regulation type glow plug according to an embodiment of the invention.

Referring to FIG. 1 which shows a self-regulating type glow plug 1 according to the invention, a metallic shell 2 has a ceramic heater 4 which extends beyond a front end of the metallic shell 2 through a metallic sleeve 5. The ceramic heater 4 is made of a heat-resistant insulator with silicon nitride ($Si_3N_4$) as a main component. Into the ceramic heater 4, is a glow resistor 3 integrally embedded which is made from an alloy of tungsten (W) and rhenium (Re) to present a positive temperature characteristic. One end of the glow resistor 3 is electrically connected to the metallic shell 2 through the metallic sleeve 5, while the other end of the glow resistor 3 connected to a cap metal 7 which is fixed to a rear end of the ceramic heater 4.

Within the metallic shell 2, is a metallic tube 13 placed which is filled with a thermally insulating material 6. Such as magnesia (MgO) into the metallic tube 13, is a temperature-regulating resistor 9 which is made from nickel (Ni) coils, iron (Fe) coils or coils of nickel-iron alloy including (30% iron) to present a positive temperature characteristic in the same manner as the glow resistor 3. A positive temperature coefficient of the glow resistor 3 is smaller than that of the temperature-regulating resistor 9 as understood by comparing the material of the glow resistor 3 and that of the temperature-regulating resistor 9. One end of the temperature-regulating resistor 9 is electrically connected to the cap metal 7 to be in series with the glow resistor 3 by way of a lead electrode 8, while the other end of the temperature-regulating resistor 9 connected to a terminal electrode 12 which a nut 11 secures to a rear end of the metallic shell 2 by way of an O-ring 10*a* an insulation cap 10.

In this instance, an electrical resistance ratio of the temperature-regulating resistor 9 to the glow resistor 3 is determined to be 0.35 by way of example. Therefore, the electrical resistance value of the glow resistor 3 is 300 mΩ when the electrical resistance value of the temperature-regulating resistor 9 is 105 mΩ. It is noted that the electrical resistance ratio of the temperature-regulating resistor 9 to the glow resistor 3 falls within a range from 0.35 to 0.60 at room temperature. When the glow plug 1 is reduced into a practical use, the electrical resistance value of the glow resistor 3 is within a range of 300 mΩ ~ 380 mΩ. This eventually leads to the electrical resistance value of the temperature-regulating resistor 9 being 105 mΩ ~ 228 mΩ.

When the glow plug 1 is energized at the time of starting the diesel engine, the ceramic heater 4 is made red-hot by electrical current supplied to the glow resistor 3 through the terminal electrode 12, the temperature-regulating resistor 9 and the lead electrode 8, and thus burning a part of vaporized fuel injected into an auxiliary combustion chamber (not shown) of the diesel engine cylinder to cope with cold starting.

Figure 2:
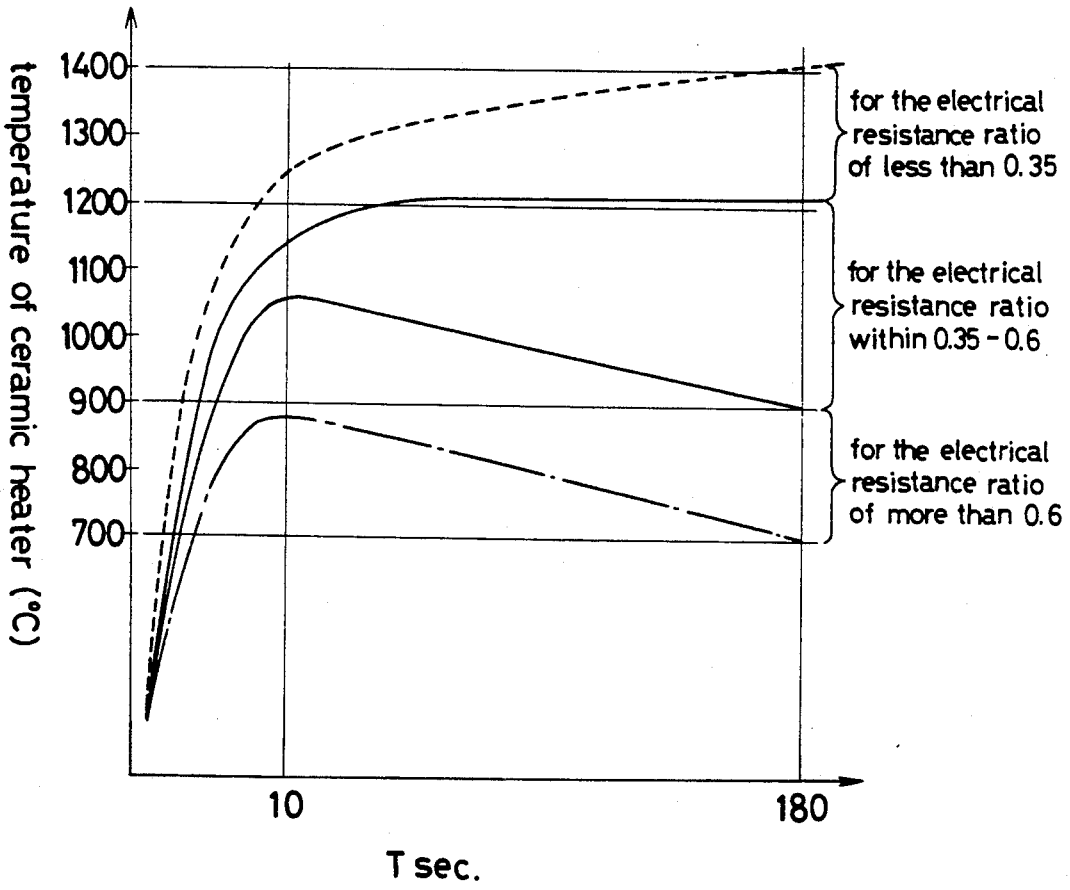
FIG. 2 is a graph showing how a relationship between temperature of a ceramic heater (°C) and energization time (T sec.) changes depending upon an electrical resistance ratio of a temperature-regulating resistor to a glow resistor.

As indicated by FIG. 2 which shows a graph showing how a relationship between temperature (°C.) of the ceramic heater 4 and energization time (T sec.) changes depending upon an electrical resistance ratio of the temperature-regulating resistor (Ni-Fe alloy) 9 to the glow resistor (W-Re alloy) 3, the electrical resistance ratio of more than 0.35 maintains its good self-regulating function to substantially keep the temperature of the ceramic heater 4 between 900° C. to 1200° C. during 180 seconds after starting the diesel engine. This makes it possible to prevent the temperature of the ceramic heater 4 from abnormally rising so as to protect the ceramic heater 4 against the breakage even when the glow plug 1 is kept energized longer after starting the engine.

As also shown in FIG. 2, the electrical resistance ratio of less than 0.60 prevents the self-regulating function from being excessively affected so as to prevent an overheat of the temperature-regulating resistor 9, thus facilitating the temperature rise of the ceramic heater 4 to ensure the cold starting of the diesel engine.

Since the electrical resistance ratio of the temperature-regulating resistor to the glow resistor is within the range from 0.35 to 0.60 inclusive, it enables to prevent the temperature of the ceramic heater from abnormally rising so as to protect the ceramic heater against the breakage even when the glow plug 1 is kept energized longer after starting the engine, while preventing the self-regulating function from being excessively affected so as to prevent an overheat of the temperature-regulating resistor thus facilitating the temperature rise of the ceramic heater to ensure the cold starting of the diesel engine.

Figure 3:
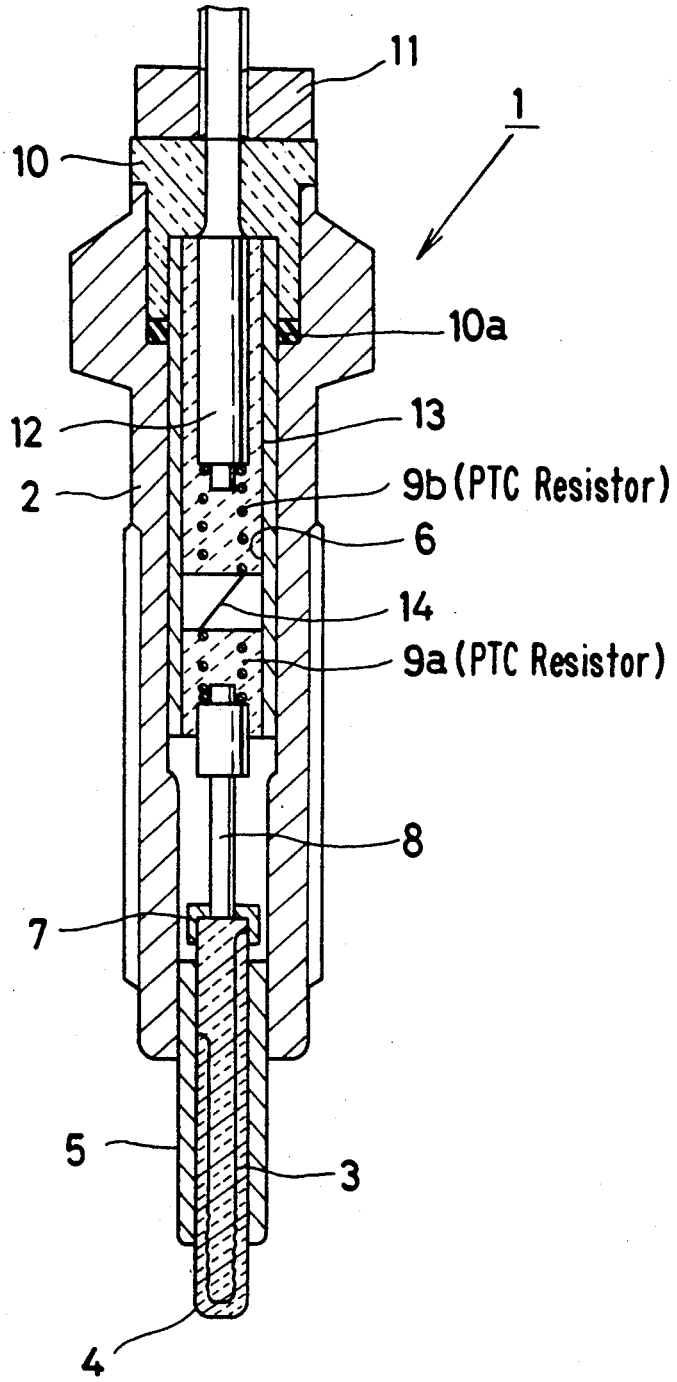
FIG. 3 is a view similar to FIG. 1 according to a modified form of the invention.

FIG. 3 shows a modification form according to the above-mentioned embodiment of the invention. This modification form provides two resistors 9*a*, 9*b* of different positive temperature coefficients connected in series by way of a lead wire 14 instead of the temperature-regulating resistor 9. This is convenient particularly upon predetermining a higher positive temperature coefficient with combined resistors having lower positive temperature coefficients.

It is appreciated that the glow resistor and the temperature-regulating resistor may be in the form of double helical configuration.

Further, it is noted that the insulation cap 10 may be made of an elastic rubber.

The ceramic heater 4 may be circle, ellipses or polygon in cross section.

It is also appreciated that the glow resistor 3 is made of an alloy of tungsten (W) and rhenium (Re), the rhenium (Re) may be 10 wt %~30 wt %.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A self temperature control type glow plug comprising:

a metallic shell in which a ceramic heater is placed in a manner to extend beyond a front end of the metallic shell, the ceramic heater having a glow resistor embedded therein;

a temperature-regulating resistor placed within the metallic shell in series with the glow resistor;

each of the resistors having a positive temperature coefficient, the positive temperature coefficient of the glow resistor being smaller than that of the temperature-regulating resistor; and an electrical resistance ratio of the temperature-regulating resistor to the glow resistor falling within a range from 0.35 to 0.60 at room temperature.

2. A self temperature control type glow plug as recited in claim 1 wherein the glow resistor is made from tungsten-based alloy and the temperature-regulating resistor from nickel, iron or nickel-iron alloy.

3. A self temperature control type glow plug as recited in claim 1 wherein the ceramic heater is made of a heat-resistant insulator with silicon nitride ($Si_3N_4$) as a main component.

4. A self temperature control type glow plug as recited in claim 1 wherein the electrical resistance value of the glow resistor is within a range of 300 mΩ~380 mΩ, while the electrical resistance value of the temperature-regulating resistor is 104 mΩ~228 mΩ.

* * * * *